United States Patent [19]

Gamm

[11] Patent Number: 4,697,363

[45] **Date of Patent: * Oct. 6, 1987**

[54] ATHLETIC SHOE POCKET

[75] Inventor: Robert J. Gamm, Olivette, Mo.

[73] Assignee: Kangaroos U.S.A., Inc., Chesterfield, Mo.

[ * ] Notice: The portion of the term of this patent subsequent to Oct. 27, 1998 has been disclaimed.

[21] Appl. No.: 802,936

[22] Filed: Nov. 27, 1985

Related U.S. Application Data

[60] Continuation of Ser. No. 486,894, Apr. 20, 1983, abandoned, which is a continuation of Ser. No. 231,251, Feb. 3, 1981, Pat. No. 4,384,414, which is a division of Ser. No. 107,092, Dec. 26, 1979, Pat. No. 4,296,559.

[51] Int. Cl.[4] ..... A43B 23/00; A43B 5/00

[52] U.S. Cl. ..... 36/136; 36/114

[58] Field of Search ..... 36/136, 132, 1, 129, 36/114; D2/309

[56] References Cited

U.S. PATENT DOCUMENTS

| | | | |
|---|---|---|---|
| 654,388 | 7/1900 | Diemer | 36/136 |
| 1,100,758 | 6/1914 | McAuslin | 36/136 |
| 2,662,677 | 12/1953 | Perry | 36/136 |
| 2,712,700 | 7/1955 | Solomon | 36/136 |
| 2,801,477 | 8/1957 | Adams et al. | 36/136 |
| 3,018,570 | 1/1962 | Bliese | 36/136 |
| 4,280,287 | 5/1983 | Gulbransen | 36/136 |

FOREIGN PATENT DOCUMENTS

| | | | |
|---|---|---|---|
| 1447044 | 6/1966 | France | 36/136 |
| 302862 | 12/1928 | United Kingdom | 36/136 |

*Primary Examiner*—James Kee Chi

*Attorney, Agent, or Firm*—Paul M. Denk

[57] ABSTRACT

In an athletic shoe having a pocket, generally disposed laterally and mounted upon the quarter portion for the shoe, the pocket comprises a liner of material, or a pair of the same, each stitched or otherwise fastened to the side of the shoe, so that the front and back edges of the pocket are confiningly affixed to the shoe, while the bottom edge of the pocket may be stitched to the quarter panel upwardly of the sole, or the same may be secured with the shoe through the effort of the stitching that holds the sole shank to the shoe quarter portion. Proximate the upward edge of the formed pocket, in one embodiment, is stitched to the shoe near the location of its eyestay, and having a zipper provided through the pocket, or at least its front liner, to attain access into the pocket and wherein miscellaneous personal items may be located for safe keeping, particularly during shoe usage, as when jogging. In another embodiment the upper edge of the pocket remains open, is formed as a slot, and into which the items may be inserted into the pocket. In another embodiment, a flap may secure also with the shoe along its eyestay, and capable of being folded over into contiguity upon the pocket, and held thereat by means of a fastener, such as Velcro, so as to provide further closure for the formed pocket, and in addition add to the attractiveness of the shoe during usage.

2 Claims, 9 Drawing Figures

ATHLETIC SHOE POCKET

CROSS REFERENCE TO RELATED APPLICATION

This application is a continuation of the application having Ser. No. 486,894, filed on Apr. 20, 1983, now abandoned, and which this application is defined as a continuation, of the appliction having Ser. No. 231,251, filed Feb. 3, 1981, now being U.S. Pat. No. 4,384,414, which in turn is a division of Ser. No. 107,092, filed Dec. 26, 1979, and now U.S. Pat. No. 4,296,559.

BACKGROUND OF THE INVENTION

This invention relates generally to athletic shoes, and more particularly pertains to a formed pocket arranged laterally of the shoe and having utility for temporary storage of personal items during shoe usage, as when employed for jogging.

Safety of personal items has always been foremost in one's thoughts, and in the earlier days, when vandalism and theft from the person were more widespread, various means were employed for assuring the safety of one's personal items particularly where some wealth was involved. For example, in the early U.S. patent to Diemer, U.S. Pat. No. 654,388, upon a shoe, a means for securing valuables concealingly within the calf portion of the shoe, and more specifically upon its internal portion that rest against the leg, was given consideration. Thus, the shown embodiment provided means for securing one's valuables, such as money, and in addition to furnishing concealment of the same in the event that one was personally accosted, as by a thief. Various other forms of similar type pocket structures used in association particularly with boots are also shown in the earlier U.S. patents to Wirsching, U.S. Pat. No. 1,289,341, McAuslin, U.S. Pat. No. 1,100,758, in addition to the patent to Avis, U.S. Pat. No. 1,342,149.

More contemporary inventors have given throught to various types of structures for forming pocket structures within shoes and boots, and such is shown in the U.S. Pat. to Corley, U.S. Pat. No. 2,908,982. In addition, the concept of adding decorativeness to the shoe through the addition of a purse or the like, as by attaching the same upon the frontal shoe upper, is shown in the U.S. patent to Bliese, U.S. Pat. No. 3,018,570, in addition to the U.S. patent to Solomon, U.S. Pat. No. 2,712,700. Furthermore, adding a holding means having some utility to the shoe, as by securing the same through its laces to the shoe, is shown in the golf tee holder as devised by Perry in his U.S. Pat. No. 2,662,677. All of the foregoing embodiments have utility for holding some component or personal item, such as money, in a concealed fashion upon its wearer, while the current invention, to the contrary, intends to provide a pocket part that can be built structurally integrally of the quarter part or portion of the shoe, so as to hold smaller personal items such as keys and money, while further incorporating, in certain instances, a flap means that protectingly covers the pocket and further enhances the ability of the shoe to prevent untimely loss of such items.

It is, therefore, the principal object of this invention to provide a pocket part that is structurally built into the quarter portion of a shoe, and incorporates closure means, such as a zipper, so as to assure that personal items such as keys and money will not be inadvertently lost by the wearer, and particularly a jogger, during a running session.

Another object of this invention is to provide a pocket means that is integrally structured into the quarter portion of an athletic shoe and may incorporate a covering flap that assures retention of personal items within the formed pocket, while simultaneously enhancing the attractiveness of the shoe.

Another object of this invention is to provide fastening means, in the nature of Velcro, or the like, that assures adherence of the covering flap upon and to the shoe pocket and to obviate its loosening or flapping as while the wearer participates in jogging, or other related sports that entail intensive running.

Another object of this invention is to provide a shoe pocket, conveniently built into the structure of the shoe, and which incorporates an upper slot into which personal items may be quickly inserted without necessitating further manipulation of the shoe or any of its other component parts.

Another object of this invention is to provide a shoe pocket integrally formed into the structure of the shoe and which can be conveniently and promptly installed during a stage of shoe assembly.

These and other objects will become more apparent to those skilled in the art upon reviewing the summary of this invention, and upon undertaking a study of the description of its preferred embodiment in view of the drawings.

SUMMARY OF THE INVENTION

This invention contemplates the formation of an athletic shoe, and more specifically one having a pocket part or portion structured into the shoe side or quarter part, this construction generally being formed through the addition of a layer of material to the shoe side, being stitched thereto as along its front and back edges, along its lower edge, and as in the principal embodiment, by also stitching the upper edge of the liner of material directly to the eyestay of the formed shoe. In this embodiment, a zipper or other means for forming closure is arranged preferably within the upper region of the pocket liner, and when opened, forms an entrance into the pocket part and into which the aforesaid type of personal items may be inserted. And, the zipper may then be closed to assure safe confinement of such items while the shoe is employed in usage, and subjected to rather impacting forces and movement. A flap may be provided for forming coverage upon the linear formed pocket, with the flap along its upper edge being also stitched or otherwise fastened by the eyestay stitching to the shoe, so such flap may be folded over into an overlying relationship contiguously against the shoe pocket, and held thereto by means of some form of fastening means, such as Velcro, or the like.

This invention includes various modifications to the basic pocket structure as previously explained, and includes the fabrication of the pocket from either one or a pair of liner material, which are stitched directly to the shoe quarter, and wherein a singular liner may be employed, it forms the outer surface of the pocket, with the shoe side then providing the back side of the pocket upon its interior. And, another embodiment may utilize a pair of liners, wherein the outer liner naturally forms the outer portion of the pocket, while the inner liner forms its back side and which rests contiguously against the surface of the shoe quarter. Either embodiment may incorporate the zipper type of closure in its upper region, as previously explained, or in the alternative, the upper portion of the outer liner, or individual liner, may be formed as an open slot, and through which the personal items may be inserted for safe keeping. Where this slot form of opening is furnished, it is desirable to include some stitching partially along the upper forward and back edges of this liner, so as to provide some closure at these locations, and to prevent the inadvertant release, or easing free, of any keys or coins that may be located within the pocket. And, one of the aforesaid types of flap also may be stitched to the shoe at the location of its eyestay, particularly where the slot form of pocket opening is furnished, with this flap then being folded over into contiguity against the pocket, having its fastening means connected, such as through attachment by the use of Velcro, and furnish closure for the slotted pocket, or in the instance where a zipper form of closure is provided, at least to form an overlying relationship upon the pocket for symmetry and enhancement of its appearance.

DESCRIPTION OF THE PREFERRED EMBODIMENT

Figure 1:
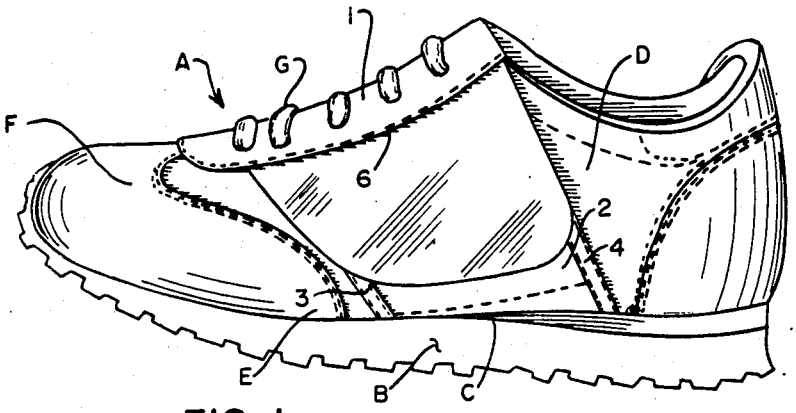
FIG. 1 provides a side view of a shoe pocket with flap formed upon the quarter portion of an athletic shoe.
Figure 2:
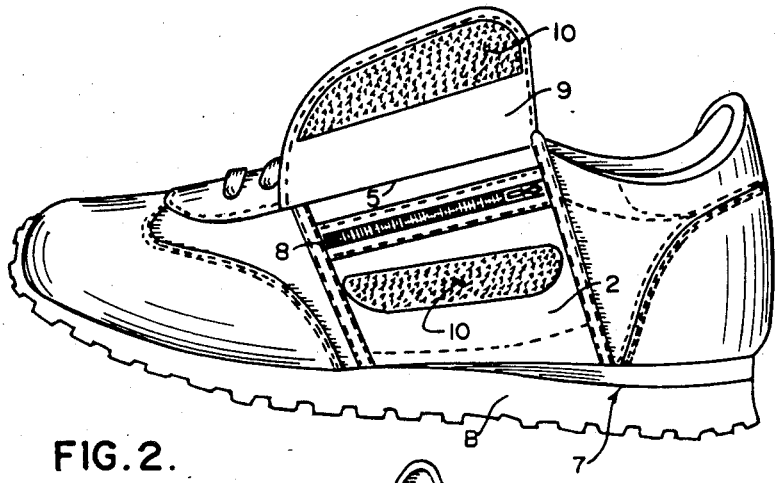
FIG. 2 furnishes a similar side view to that shown in FIG. 1, with the closure flap being raised upwardly so as to disclose fully the pocket and its fastening means.
Figure 3:
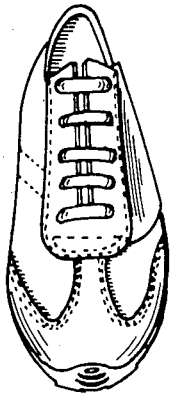
FIG. 3 provides a frontal oblique front view of the athletic shoe with pocket.

In the drawings, and in particular in FIGS. 1 through 3, there is shown in both side and front views an athletic shoe A of the usual construction and having a sole portion B stitched at its shank C to the shoe quarter D, the vamp E, and shoe upper F as normally constructed into an assembled shoe. In addition, an eyestay 1 is also stitched to the shoe quarter at its upper margin, and useful for securing laces G that hold the emplaced shoe upon the foot. In this particular invention, a liner of material, as at 2, and comprising therein a singular or pair of liners, is also stitched along its reinforced front and rear seams 3 and 4, respectively, and has its upper edge, as at 5, also held by means of the stitching 6 that secures the eyestay and said pocket forming liners 2 securely within the shoe construction. The lower edge of the liner 2 is turned under with the shoe quarter D, as at 7, and is stretched along the shank for adherence with the sole B of the disclosed shoe.

With the attachment of the pocket linings to the shoe quarter, or its sides, and with either a singular or double lining being employed, the shoe pocket is thus formed and secured with the side of the shoe. Provided preferably within the upper region of the formed pocket is a closure means, such as the zipper 8 as shown, and the zipper is provided through the outermost pocket lining, in those instances where a pair of linings form the pocket, so that the space between said linings form the desired pocket. By simply manipulating the zipper from front to back, or vice versa, for providing its opening, personal items such as keys or coins may be inserted into the pocket for safe keeping as during participation within an athletic event, such as while one is jogging and running. The pocket, in this formation, is adequate for providing safe keeping for such items, but the usual jogging paraphernalia, such as shorts, or a sweat suit, ordinarily do not contain pockets, and if they do, it is very likely that coins or keys may be easily lost due to the quick motions encountered during jogging. To further add to the structure of the shown invention, a flap 9 also secures upwardly of the shoe quarter or side, being stitched by means of the stitching 6 at the location of the eyestay, and said flap may be conveniently folded over into contiguity against the formed shoe pocket, so as to provide coverage upon the same and to insure the safety of any items contained within the pocket, and likewise, to add to the pleasing appearance of the shoe aesthetics by covering the closure means such as the zipper as shown. Such a flap is not essential to the shoe construction for insuring the proper operation and usage of its pocket, but it does add to the safe keeping of the pocketed items, and in addition, adds to the overall attractiveness of the shoe. In addition, fastening means, such as the Velcro 10, or other fastening means, as shown, may be provided upon the downward inner surface of the flap 9, in addition to being provided in alignment upon the pocket 2, as can be seen, so that when the flap 9 is folded over into an overlying relationship with the formed pocket, such fastening means conveniently holds the flap contiguous with the shoe, and assures its retention thereat so as to prevent its flapping, as when the athletic shoe is being used.

When the pocket 2 is formed from a single liner of material, then obviously that single liner forms the outer surface for the formed pocket, while the shoe side or quarter itself acts as the inner surface for the constructed pocket.

Figure 4:
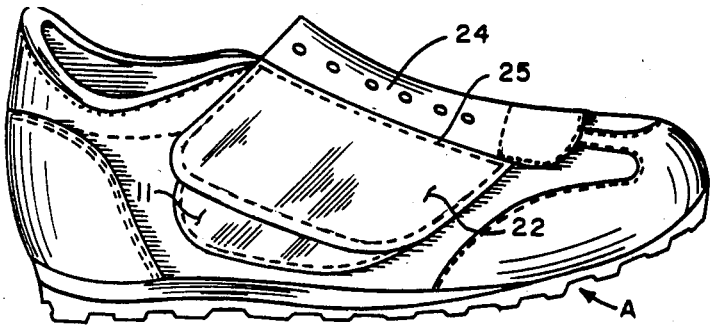
FIG. 4 furnishes a side view of a modified type of shoe pocket with flap.
Figure 5:
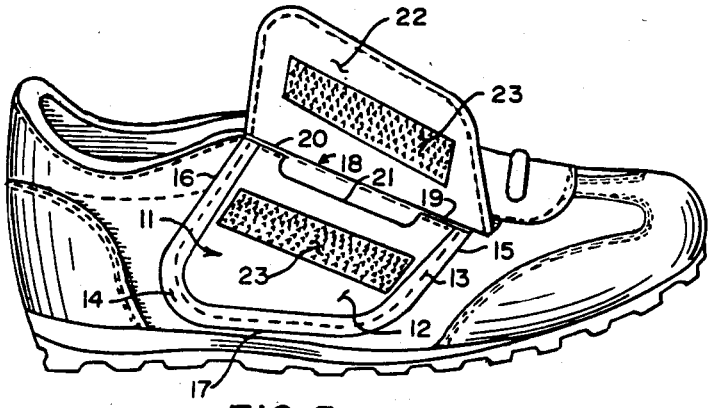
FIG. 5 discloses a similar side view to that of the athletic shoe disclosed in FIG. 4, with the closure flap being raised so as to show the pocket with its upper slot.
Figure 6:
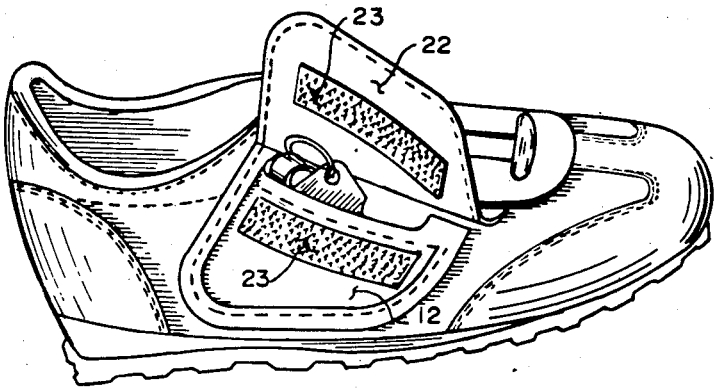
FIG. 6 discloses a similar view to that shown in FIG. 5, with keys in the process of being inserted into the shoe pocket.

As shown in FIGS. 4 through 6, there is provided various side views of a modified form of athletic shoe with pocket for use in holding miniscule personal items. As can be seen, the shoe A also incorporates a formed pocket 11, which in this instance, also can be formed to be either of a single or double layer of liner material. The outer liner 12 is herein shown as being stitched by means of the threading 13 around the pocket's reinforced periphery 14. More specifically, in this particular instance, the pocket through both its liners, is formed having its front and rear edges 15 and 16, respectively, being stitched directly to the shoe quarter, and in this particular embodiment, the bottom edge 17 of the pocket is also stitched to the shoe side, and not turned inwardly between the sole and shoe quarter, as aforesaid, to be stitched along the shoe shank as described in the previously identified embodiment. The upper edge of this pocket, as at 18, is formed as an open slot, with the front and back edges 19 and 20 being stitched to the shoe quarter, at this location, so as to provide some closure at least at these ends for the said formed slot 18. The pocket is cut slightly lower, as at 21, at its central location, so as to facilitate its opening and the insertion of keys or other items therein, such as shown in FIG. 6, for their safe keeping. In addition, and specifically in this particular embodiment, it is rather necessary that a flap 22 be provided for forming coverage over the identified pocket, with the flap having generally the same shape or outline as its underlying pocket, as when it is folded over into closure. Furthermore, the flap, and the underlying pocket, once again, may contain a type of fastening means, such as the Velcro 23 as shown, and it can be releasably fastened against the pocket and prevented from movement when the shoe is employed in usage. The flap can be secured to the shoe quarter by being stitched along with the eyestay 24 stitching, as at 25, so that it can be appended to the athletic shoe during its initial assembly.

Figure 7:
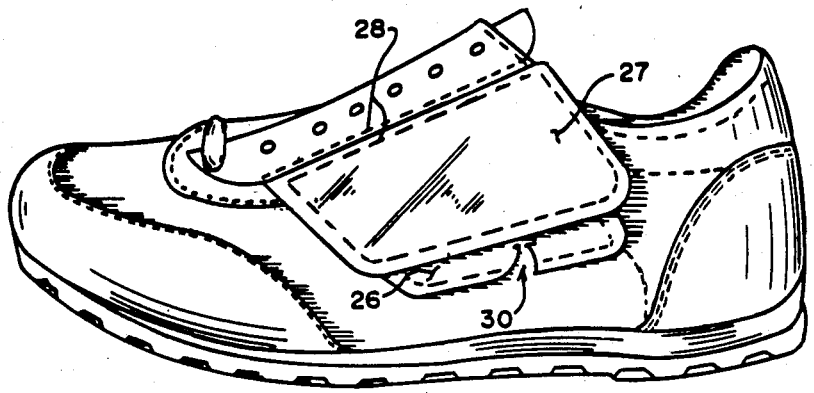
FIG. 7 discloses a further modification to the shoe pocket as applied to an athletic shoe.
Figure 8:
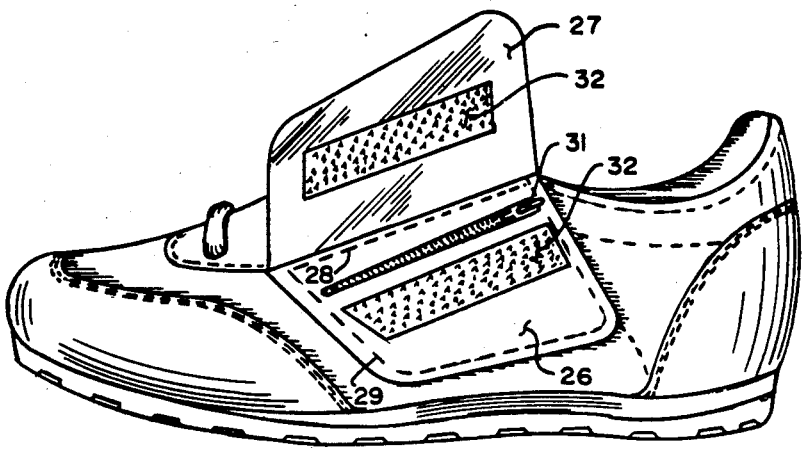
FIG. 8 discloses the same athletic shoe with pocket as revealed in FIG. 7, with its closure flap being raised so as to fully disclose the pocket.
Figure 9:
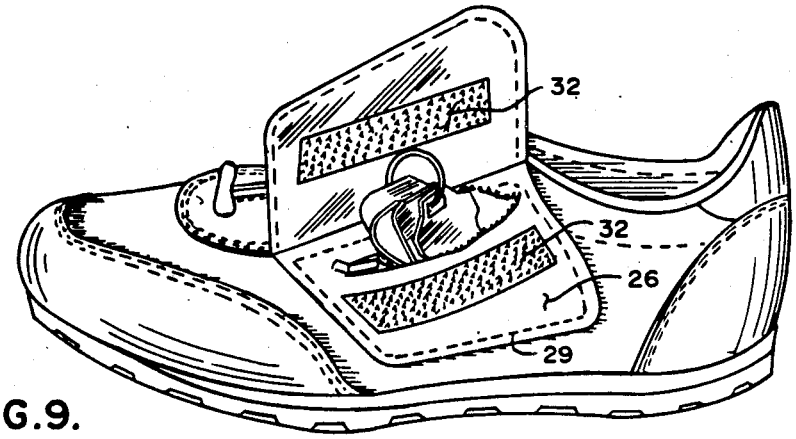
FIG. 9 shows the same athletic shoe as disclosed in FIG. 8, with personal items such as keys in the process of being inserted therein.

Still another modification to this invention is shown in FIGS. 7 through 9, with the shoe pocket 26 being constructed very similarly to that pocket 12 previously described in FIGS. 4 through 6. But, in this particular instance, the pocket will yet be stitched with its flap 27 through the usage of the eyestay stitching 28, with said flap then providing overlapping coverage upon the pocket 26 during usage. And, said pocket is also stitched around its back, bottom, and front edges through the effort of the stitching 29. In this particular instance, the pocket is formed having a single liner, and this can be seen through the partial cut away 30 as disclosed in FIG. 7, so that when the single liner is attached to the shoe quarter, it forms the outer surface for the pocket, with the side of the shoe forming the interior of the assembled pocket. But, as previously explained, it is just as likely that a pair of liners may be used for forming this pocket, with the outer liner serving the purpose of the outer surface of the pocket, as at 26, as shown in the drawings, with the inner forming the back side of the pocket as secured to the side of the shoe.

As can also be seen in this modification for the shoe pocket, as identified in these drawings, other attributes of the shoe pocket formed as shown in FIG. 2 are also incorporated in this modified design, and it can be seen that a closure means, such as the zipper 31, is formed within the upper region of the pocket 26, and when opened, allow for the insertion of any personal items, such as the keys as shown in FIG. 9, within the pocket for safekeeping after the zipper is once again urged into closure. And, once again, fastening means may be used for holding the flap 27 upon the pocket 26, and fastening such as the Velcro 32 has been found useful for this purpose.

In view of this description of the preferred embodiment, and in its various modifications, it can be seen that a conveniently disposed pocket for holding rather necessary items can be formed directly onto the shoe structure, which items are essential to even the athlete when he may be undertaking his daily exercise. Obviously some money may be required for personal usage while out jogging, and certainly, when one returns to his place of residency, a key is required for entrance. Thus, the shoe pocket of this invention adds significantly to the convenience of the jogger in providing a safe and secure location where such items may be temporarily stored, without fear of their loss even while being subjected to repeated alternating motions such as encountered by the foot during participation in athletics, and particularly while running or jogging.

The description of the preferred and modified embodiments defined herein may be slightly varied in their construction in light of the foregoing specification. For example, the zipper means may be arranged at a lower location. Any such modification or variations, if within the spirit of the invention defined herein, are intended to be encompassed within and protected by any claims to patent protection issuing upon this invention. The analysis of the invention as herein made is set forth for illustrative purposes only.

Having thus described the invention what is claimed and desired to be secured by Letters Patent is:

1. An athletic shoe formed of flexible material and incorporating a pocket, comprising, an athletic shoe having a quarter portion, sole, vamp, counter, and eyestay, all securing together to form said shoe, an expansive pocket secured on the outside of said quarter portion, said pocket being of sufficiently substantial material integrally fastened with sufficient strength to said quarter portion to hold small sized personal items such as keys, coins, or the like therein, said pocket having at least one layer of flexible material contiguously disposed to the outside of the flexible material forming the quarter portion and thereby functioning to secure said type of items therein, an access opening in said pocket for inserting one of said items into said pocket, said flexible material forming the pocket being of substantial size and extending approximately from the shoe eyestay to approximately its sole shank, and approximately between the shoe counter to its vamp portion, stitching securing at least the front and back edges of the pocket to the said shoe quarter portion, said pocket having an upper edge, the upper edge of said pocket being affixed to said shoe along its eyestay, closure means for closing said access opening, and said closure means extending approximately from one edge to another edge of the formed pocket, whereby said pocket functioning to hold said personal items such as keys or coins therein and yet permitting the wearer of said athletic shoe to participate in athletic activities without interference from such inserted items.

2. The invention of claim 1 and wherein said flexible material forming the pocket being secured at its lower part by turning under with the quarter portion for securement with the shoe sole shank.

* * * * *